US008550472B2

(12) United States Patent
Salmon et al.

(10) Patent No.: US 8,550,472 B2
(45) Date of Patent: Oct. 8, 2013

(54) ROTARY RETENTION LATCH FOR REPLACEABLE SKATE BLADE SYSTEMS

(75) Inventors: John Jasper Salmon, North York (CA); Richard Charles Hampton, King City (CA)

(73) Assignee: Multimatic Inc., Markham (CA)

( * ) Notice: Subject to any disclaimer, the term of this patent is extended or adjusted under 35 U.S.C. 154(b) by 309 days.

(21) Appl. No.: 13/055,164

(22) PCT Filed: Mar. 10, 2009

(86) PCT No.: PCT/CA2009/000338

§ 371 (c)(1),
(2), (4) Date: Jan. 21, 2011

(87) PCT Pub. No.: WO2010/009532

PCT Pub. Date: Jan. 28, 2010

(65) Prior Publication Data

US 2011/0121527 A1 May 26, 2011

(30) Foreign Application Priority Data

Jul. 25, 2008 (CA) ..... 2638352

(51) Int. Cl.
*A63C 1/00* (2006.01)

(52) U.S. Cl.
USPC ..... 280/11.12; 280/841; 280/11.17

(58) Field of Classification Search
USPC ..... 280/841, 11.12, 11.17, 11.18
See application file for complete search history.

(56) References Cited

U.S. PATENT DOCUMENTS

| | | | | |
|---|---|---|---|---|
| 2,108,128 | A | 1/1937 | Kinney | |
| 2,213,966 | A * | 9/1940 | Nygaard | 280/11.18 |
| 3,026,118 | A * | 3/1962 | Pare | 280/11.3 |
| 3,947,050 | A * | 3/1976 | Isely | 280/11.18 |
| 4,492,385 | A * | 1/1985 | Olson | 280/7.13 |
| 5,088,749 | A | 2/1992 | Olivieri | |
| 5,123,664 | A | 6/1992 | DeMars | |
| 5,248,156 | A * | 9/1993 | Cann et al. | 280/11.18 |
| 5,332,242 | A * | 7/1994 | Cann et al. | 280/11.18 |
| 5,383,674 | A | 1/1995 | Cann et al. | |
| 5,641,169 | A * | 6/1997 | Bekessy | 280/11.18 |
| 5,961,129 | A * | 10/1999 | Post et al. | 280/11.27 |
| 5,988,683 | A | 11/1999 | Venier et al. | |
| 6,485,033 | B2 * | 11/2002 | Nicoletti et al. | 280/11.18 |

(Continued)

FOREIGN PATENT DOCUMENTS

| | | |
|---|---|---|
| CA | 2025600 A1 | 5/1991 |
| CA | 1314913 C | 3/1993 |

(Continued)

OTHER PUBLICATIONS

"PCT International Search Report dated Jun. 5, 2009 for PCT/CA2009/000338, from which the instant application is based," 2 pgs.

*Primary Examiner* — J. Allen Shriver, II
*Assistant Examiner* — James M Dolak
(74) *Attorney, Agent, or Firm* — Fredrikson & Byron, P.A.

(57) ABSTRACT

A replaceable blade system for ice skates is provided with a rotary retention latch located within an enclosed chamber of the holder of the skate. The rotary retention latch is configured with a release lever that is adapted to be accessed through an aesthetic aperture in the holder.

8 Claims, 6 Drawing Sheets

(56) References Cited

U.S. PATENT DOCUMENTS

| | | | | |
|---|---|---|---|---|
| 6,695,322 | B2 * | 2/2004 | Goldsmith et al. | 280/11.12 |
| 6,761,363 | B2 * | 7/2004 | Fask et al. | 280/11.18 |
| 6,932,361 | B2 * | 8/2005 | Steinhauser, Jr. | 280/11.18 |
| 7,628,405 | B2 * | 12/2009 | Smith, II | 280/11.18 |
| 7,673,884 | B2 * | 3/2010 | Wuerthner | 280/11.18 |
| 7,758,053 | B2 * | 7/2010 | Wylie et al. | 280/11.12 |
| 2005/0134010 | A1 * | 6/2005 | Blankenburg et al. | 280/11.18 |

FOREIGN PATENT DOCUMENTS

| | | | |
|---|---|---|---|
| CA | 2574753 | A1 | 7/2008 |
| CA | 2638352 | A1 | 2/2009 |
| DE | 724488 | C | 8/1942 |

* cited by examiner

ROTARY RETENTION LATCH FOR REPLACEABLE SKATE BLADE SYSTEMS

RELATED APPLICATIONS

This application is a 35 U.S.C. 371 national stage filing from International Application No. PCT/CA2009/000338 filed Mar. 10, 2009, which claims priority to Canadian Patent Application No. 2,638,352, filed Jul. 25, 2008, the teachings of which are incorporated herein by reference.

BACKGROUND

Ice skates have been used for recreational and transportation purposes for hundreds of years. Originally, some sort of low friction sliding device akin to a metal blade was attached using straps to a conventional boot. Ultimately, in the past century, boots specifically intended for use only in ice skating evolved, typically with the blade firmly affixed to the boot. The unitary blade and boot had the advantage of rigidity allowing more speed and control than previously possible.

For many years, it has been understood that there may be an advantage to providing a replaceable sharpened blade for ice skates. With heavy use, typically a conventional skate blade will wear out before the boot portion. Accordingly, there is an advantage to extending the life of the skate by replacing the blade rather than replacing the entire skate.

Certain of the prior art attempts to provide replaceable skate blades have involved replacement of a relatively heavy, and thus expensive, metal portion of the skate with substantial removal and fastening difficulties. Some such replaceable blades were intended to be sharpened a number of times before replacement. See, for example U.S. Pat. No. 5,088,749 to Olivieri. In other prior art attempts, the replaceable blade, although lightweight, has not been effectively mounted on the rocker to provide the security required particularly by advanced skaters. See, for example, U.S. Pat. No. 2,108,128 to Kinney. Still other replacement blades have been of a complex construction not easily adapted to inexpensive commercial production. See, for example, German Patent No. 724488 to Dornseif and U.S. Pat. No. 3,947,050 to Isely. Moreover, replaceable blades have tended to be prone to breakage owing to the structure of the blade and the tension under which the blade is placed in order to stretch it along the base of a skate blade. See, for example, U.S. Pat. No. 5,383,674 to Cann, et al.

U.S. Pat. No. 5,988,683 to Venier et al. describes a replaceable blade system in which the shortcomings of the prior art, including the excess breakage associated with the Cann patent configuration, has been solved using a novel means to connect the flexible replaceable blade to the skate so that it is pulled more or less longitudinally and tensioned evenly along its length. A torque limiting device provides for easy replacement and adjustment of blades by consumers without damage to the skate or the replaceable blade. A limitation of this arrangement is that the associated attachment and tensioning mechanism is complex and requires a separate torque limiting tool to operate. An additional problem of the Venier patent is that the tensioning mechanism requires a high stiffness and high strength rigid holder for mounting.

U.S. Pat. No. 5,123,664 to DeMars describes a blade system that includes a replacement runner that may be rapidly, removably coupled to the holder of the skate. The blade system of DeMars utilizes a single piece, replacement runner that integrally incorporates a blade and is adapted to be retained in the holder of the skate by a slot and pin at its forward end and a locking mechanism at its rear end. The locking mechanism consists of a linear sliding latch with an array of springs and a release button located in the rear face of the holder. A limitation of this arrangement is that it requires a highly complex shaped cavity within the skate holder to interact with the linear sliding latch member. A further limitation of the DeMars patent is that the release button can only be placed on the rear face of the holder where inadvertent release could be induced by contact with hockey sticks, pucks and the like. Another problem with this configuration is that it requires an ejection mechanism to aid in removing the runner from the holder. Finally, the linear sliding latch mechanism of DeMars could not be integrated into styled holders that incorporate aesthetic apertures.

The present invention solves these prior art problems by providing a simple rotary retention latch located within an enclosed chamber of the holder of the skate. The rotary retention latch is configured with a release lever that is adapted to be accessed through an aesthetic aperture in the holder. This rotary latch configuration can be utilized to retain a pivoting rocker section that holds a flexible replaceable blade in tension or for securing a single piece, replaceable runner that integrally incorporates a blade. This arrangement is superior to the Venier configuration in that it does not require a separate torque limiting tool to operate, the tensioning loads are contained within the rocker so the holder can be constructed from regular plastic materials and the number of parts and complexity are significantly reduced. Additionally this arrangement is superior to the DeMars prior art in that it eliminates the requirement for a highly complex shaped cavity in the holder and integrates the release lever into an aesthetic aperture in the holder preventing inadvertent release induced by contact with hockey sticks, pucks and the like. This configuration of rotary latch that includes an integrated release lever accessed through an aesthetic aperture is extremely well suited to the industry standard hollow molded holders and provides a solution for holders that are styled with aesthetic apertures.

SUMMARY OF THE INVENTION

Accordingly, the ice skate of the present invention comprises a boot and a holder that is adapted to be mounted to the boot. The holder is of a generally hollow construction containing at least one substantially enclosed chamber. The holder is additionally styled with at least one aesthetic aperture. The aesthetic apertures are incorporated in the holder to give it a distinct appearance and are utilized to differentiate the ice skate from competitive products. Additionally, the configuration of the apertures contributes to providing a predetermined holder stiffness that enhances the skating biomechanics. The ice skate additionally includes a downward facing blade system and a unique rotary retention latch. The blade system includes a lower surface of a first defined curvature and is configured with at least one blade engagement system and comprises a blade along its lower surface. The rotary retention latch is pivotally mounted to the holder and is substantially located in the enclosed chamber of the holder and is configured to move between a blade securing position and a blade releasing position. The rotary retention latch is further configured with an attachment engagement portion accessible through a first opening in the holder to the chamber and a release lever accessible through the aesthetic aperture and adapted to move the rotary retention latch between the blade securing position and the blade releasing position. The rotary retention latch is adapted to be biased to the blade securing position by at least one biasing device. The blade system is retained in the holder via the blade engagement system detachably mating with the attachment engagement portion when extended through the first opening in the holder and when the rotary retention latch is in the blade securing position.

In an aspect of the invention, the blade is integral with the blade system.

In a further aspect of the invention, the blade system is configured with a second blade engagement system configured as a retention hook that detachably engages to a retention pin that is rigidly attached to the holder.

In a further aspect of the invention, the attachment engagement portion of the rotary retention latch is a pawl feature and the blade engagement system of the blade system comprises a striker feature.

In a further aspect of the invention, the biasing device is a spring.

In an alternative embodiment of the invention, the blade system comprises a downward facing rocker with a lower surface of the first defined curvature and a front end and a rear end. The blade system also includes a flexible replaceable blade having a second curvature when not attached to the rocker. The flexible replaceable blade incorporates an upper surface, a lower ice-contacting surface, a front end and a rear end and is adapted to be removably mounted to the rocker. The front end of the rocker is configured with a front securing means for attaching the front end of the flexible replaceable blade. The rear end of the rocker is configured with a rear securing means for attaching the rear end of the flexible replaceable blade. The flexible replaceable blade conforms to the first defined curvature of the rocker when mounted thereon. In this way a skater can easily release a used flexible replaceable blade from the rocker and simply change it for a new replaceable blade. The flexible replaceable blade curvature will then conform to the first defined curvature of the downward facing rocker.

In a further aspect of the alternative embodiment of the invention, an ice skate comprises a boot and a holder that is adapted to be mounted to the boot. The holder is of a generally hollow construction containing at least one substantially enclosed chamber. The holder is additionally styled with at least one aesthetic aperture. The aesthetic apertures are incorporated in the holder to give it a distinct appearance and are utilized to differentiate the ice skate from competitive products. Additionally, the configuration of the apertures contributes to providing a predetermined holder stiffness that enhances the skating bio-mechanics. The holder additionally incorporates an integral, downward facing rocker with a lower surface of a first defined curvature. The downward facing rocker includes a fixed front end and rear end adapted to rotate between an open position and a closed position. The ice skate also includes a flexible replaceable blade having a second curvature when not attached to the skate. The flexible replaceable blade has an upper surface, a lower ice-contacting surface, a front end and a rear end and is adapted to be removably mounted to the rocker. The front end of the rocker is configured with a front securing means for attaching the front end of the flexible replaceable blade. The rear end of the rocker is configured with a rear securing means for attaching the rear end of the flexible replaceable blade. The ice skate also includes a rotary retention latch pivotally mounted to the holder and substantially located in the enclosed chamber of the holder for movement between a blade securing position and a blade releasing position. The rotary retention latch incorporates an attachment engagement portion accessible through a first opening in the holder to the chamber and a release lever accessible through the aesthetic aperture configured to move the rotary retention latch between the blade securing position and the blade releasing position. Rotation of the rear end of the rocker between an open position and a closed position creates a tension along the length of the flexible replaceable blade without exerting the major component of tensioning force around a small radius in the region of the front and rear securing means and wherein the flexible replaceable blade conforms to the curvature of the lower surface of the rocker when mounted thereon, and the rotary retention latch retains the rotatable rear end of the rocker in the closed position when in the blade securing position.

Further aspects of the invention will become apparent from the following description.

DETAILED DESCRIPTION OF THE INVENTION

Figure 1:
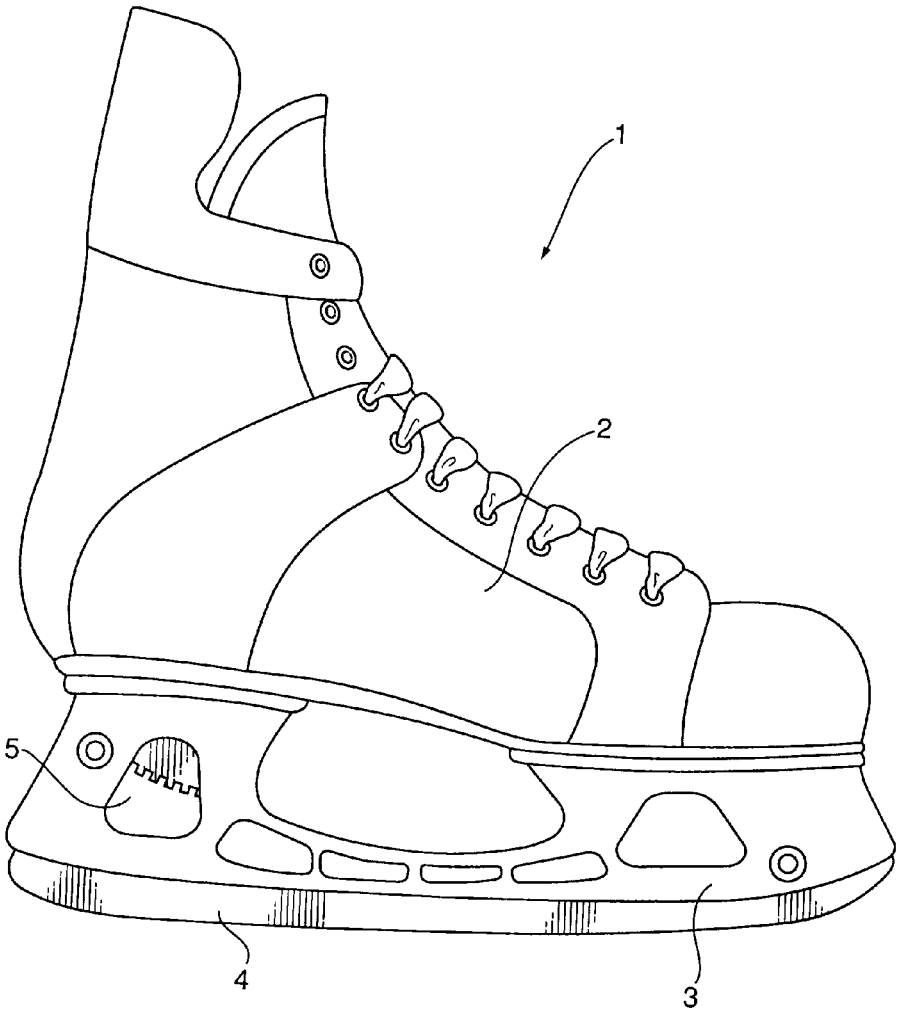
FIG. 1 is a side view of the replaceable blade ice skate assembly.

Referring to FIG. 1, a replaceable blade ice skate assembly (1) is substantially constructed from a boot (2), a holder (3) adapted to be mounted to the boot and a downward facing blade system (4). The holder (3) is styled to include at least one aesthetic aperture (5). It will be appreciated that this aperture could also have non-aesthetic functions, such as affecting the flexibility of the holder.

Figure 2:
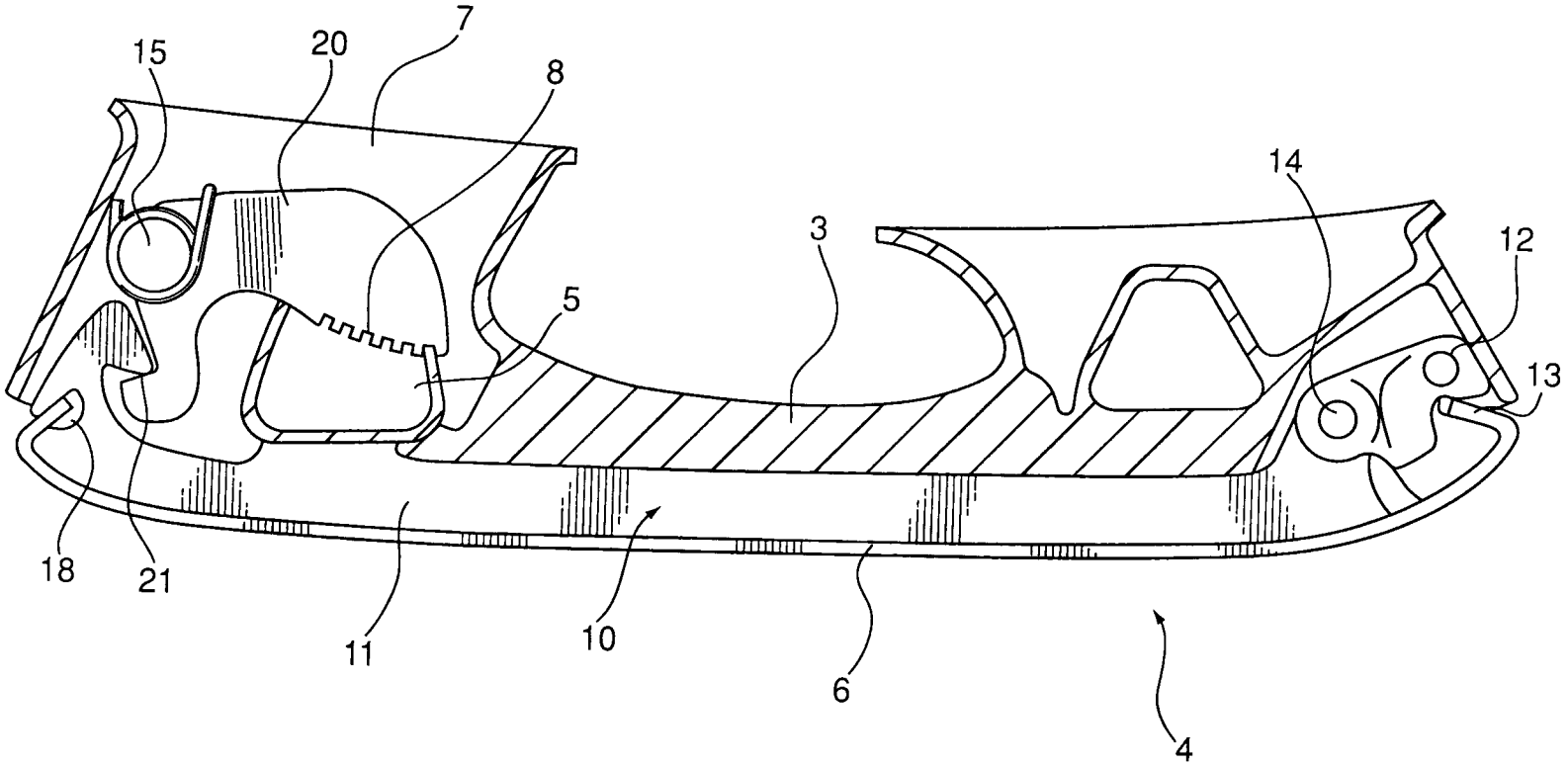
FIG. 2 is a schematic view of the holder, rocker, flexible replaceable blade and rotary retention latch shown in the closed position.
Figure 3:
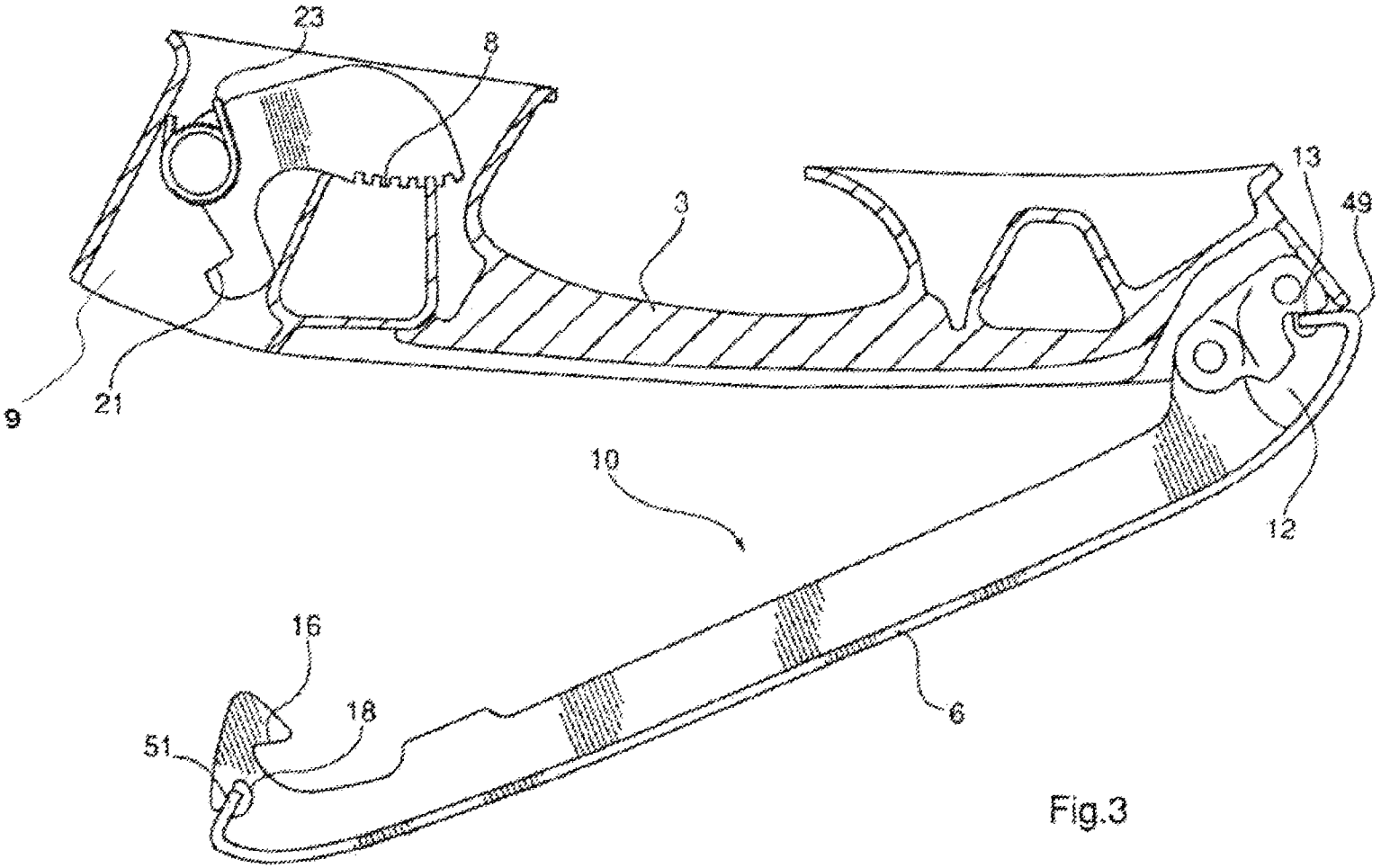
FIG. 3 is a schematic view of the holder, rocker, flexible replaceable blade and rotary retention latch shown in the open position.

FIGS. 2 and 3 illustrate a flexible replaceable blade system that consists of a downward facing blade system (4) that includes a rocker (10) that is configured with a first defined curvature along its lower ice-contacting surface and incorporates a front end (12) and a rear end (11) and a flexible replaceable blade (6). The rocker front end (12) is adapted to be immovably attached to the holder (3) via riveting, bolting or similar fastening means and is configured with a toe receiving area (13). The rocker front end (12) is configured with a pivot joint (14) which is adapted to align with an appropriate clearance hole configured in the holder (3). The rocker rear end (11) is adapted to be rotatably attached to the rocker front end (12) at the pivot joint (14) via a bushing and rivet or similar means. The rocker rear end (11) is configured with a blade system engagement portion (16) and a heel receiving area (18). A rotary retention latch (20) is adapted to he pivotally mounted to the holder (3) at a latch pivot point (15) and contained within a substantially enclosed chamber (7) within the holder. The rotary retention latch (20) is configured with a release lever (8) and an attachment engagement portion (21). The attachment engagement portion (21) is configured to interlock with the blade system engagement portion (16) which accesses the attachment engagement portion (21) through a first opening (9) in the holder to the chamber (7) so as to rigidly restrain the rocker portion rear end (11) in a closed position. The release lever (8) of the rotary retention latch (20) is adapted to be accessible through the aesthetic aperture (5) of the holder (3).

Referring to FIG. 3, a flexible replaceable blade (6) is configured with a second defined curvature and incorporates a front hook (49) and a rear hook (51). The front hook (49) is adapted to interlock with the toe receiving area (13) of the rocker front end (12) and the rear hook (51) is adapted to interlock with the heel receiving area (18) of the rocker rear end (11).

In a preferred embodiment of the invention, the blade engagement system (16) comprises a striker feature. The rotary retention latch (20) is adapted to be pivotally mounted to the holder (3) at a latch pivot point (15) and the attachment engagement portion (21) comprises a pawl feature. The attachment engagement portion (21) is configured to interlock with the striker feature of the blade system engagement portion (16) so as to rigidly restrain the rocker rear end (11) in a closed position.

Figure 6:
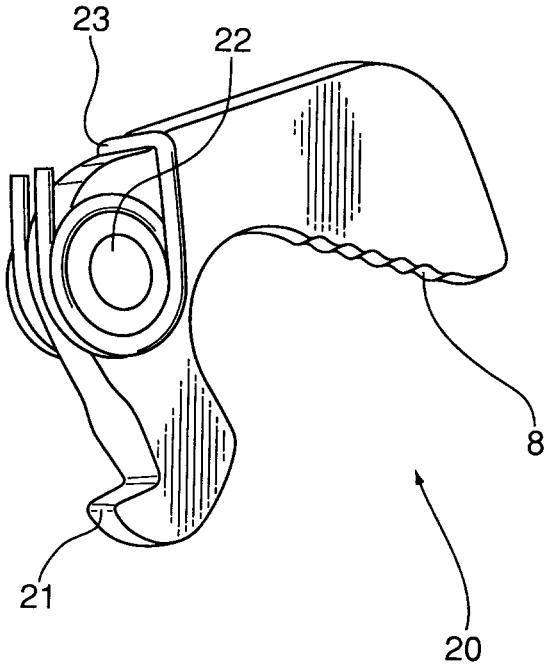
FIG. 6 is a perspective view of the retention latch.

FIG. 6 illustrates the rotary retention latch (20) that would be typically manufactured from moulded plastic such as Nylon. The rotary retention latch (20) is configured with an attachment engagement portion (21), release lever (8) and a pivot hole (22). A biasing device, preferably a spring (23) that would be typically manufactured from steel wire, is configured so as to impart a torque that biases the attachment engagement portion (21) into contact with the striker feature of the blade system engagement portion (16) of the rocker rear end (11) as illustrated in FIG. 2. When a skater imparts an operating force on the release lever (8) the spring torque is overcome and the attachment engagement portion (21) is released from the striker feature of the blade system engagement portion (16) allowing the rocker rear end (11) to rotate from the closed to the released position as illustrated in FIG. 3. The shape and geometric association of the release lever (8) relative to the pivot hole (22) is configured so as to place it within the aesthetic aperture (5) of the holder (3) and make it appear to be integrated into the overall style of the boot (2) and holder (3).

The process of attachment of the blade to the rocker will now be described in further detail. The rocker rear end (11) is placed in its released position as illustrated in FIG. 3. The front hook (49) of the flexible replaceable blade (6) is hooked into the toe receiving area (13). Next, the rear hook (51) of the flexible replaceable blade (6) is hooked into the heel receiving area (18). The rocker rear end (11) is then rotated around the pivot joint (14) towards the closed position. As the rocker rear end (11) rotates, the heel receiving area (18) moves rearward relative to the toe receiving area (13) due to the radius defined by the pivot joint (14) being shorter than that defined by the overall flexible replaceable blade (6) length. The rearward movement of the heel receiving area (18) causes the flexible replaceable blade (6) to be tensioned substantially along its longitudinal axis. This helps to prevent the blade from breaking owing to excessive bending stress which can occur if the blade is tensioned around a corner or small radius (as would occur in certain prior devices such as Cann). As the flexible replaceable blade (6) is tensioned and pulled onto the downwardly facing rocker (10), its curvature conforms to the first defined curvature of the downwardly facing rocker (10). When the rocker rear end (11) reaches the closed position, the attachment engagement portion (21) of the rotary retention latch (20) is biased into engagement with the striker feature of the blade system engagement portion (16) by the latch spring (23) so that the rocker portion rear end (11) is rigidly restrained in position. In this manner the limitations of the Venier patent are overcome by eliminating the need for a separate torque limiting tool to tension the flexible replaceable blade and the requirement for a high stiffness and high strength rigid holder is avoided.

Figure 4:
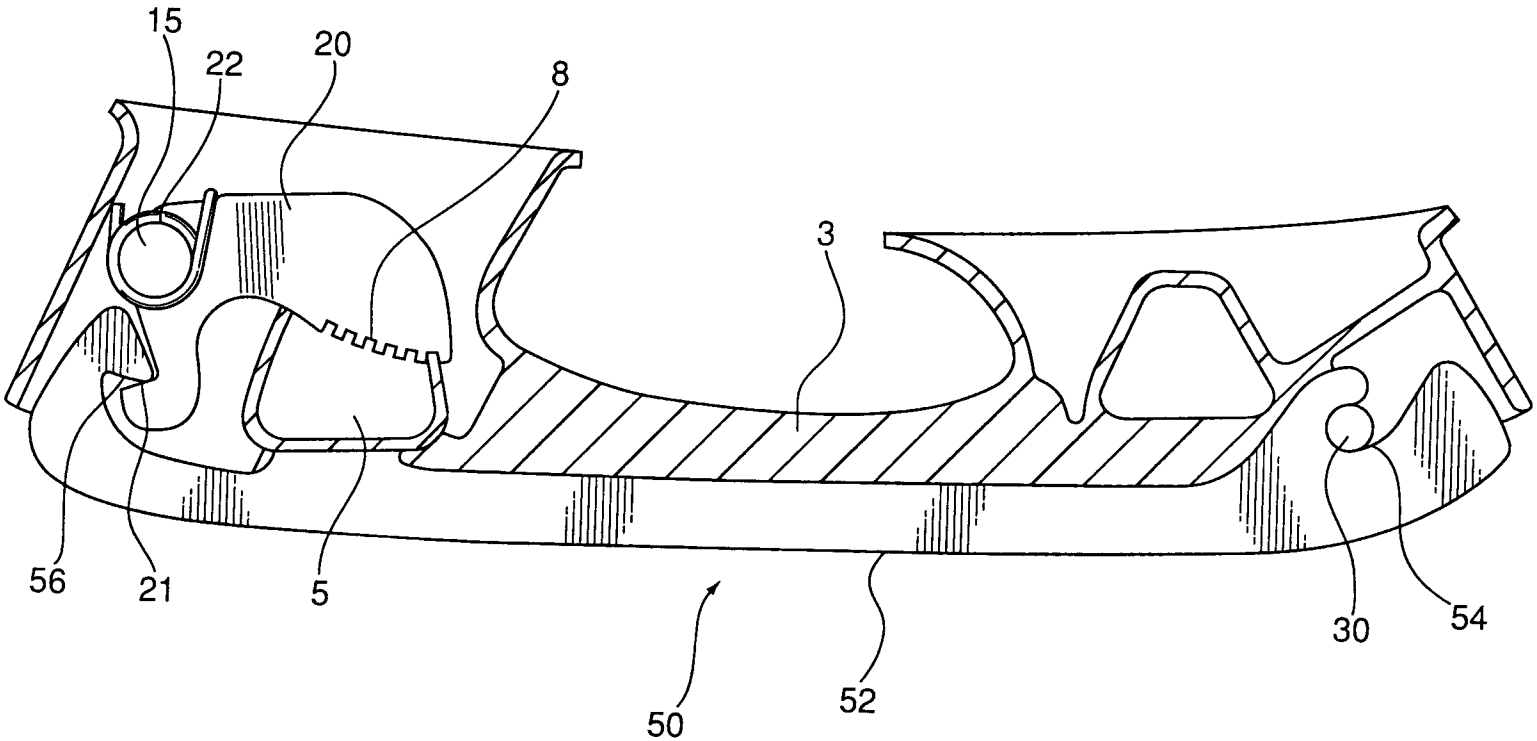
FIG. 4 is a schematic view of the holder, blade system and rotary retention latch shown in the secured position.
Figure 5:
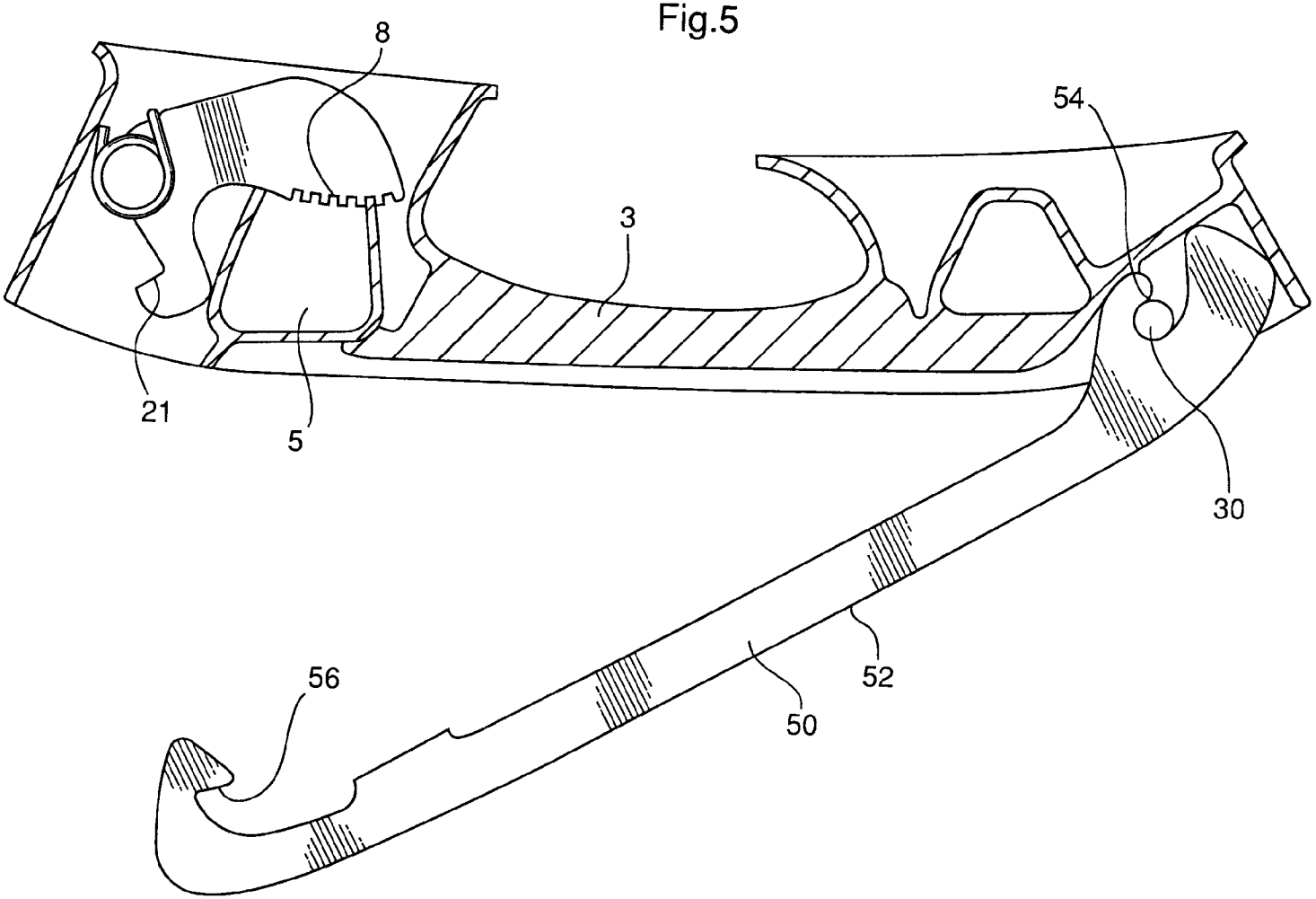
FIG. 5 is a schematic view of the holder, blade system and rotary retention latch shown in the released position.

An additional preferred embodiment of the present invention is illustrated in FIGS. 4 and 5. This embodiment involves the usage of a single piece, downward facing blade system which integrally incorporates a blade and is attached to the holder (3) via the previously described flexible replaceable blade retention system. This configuration is substantially constructed from a boot, a holder (3) adapted to be mounted to the boot and a blade system (50). The holder (3) is configured with a latch pivot point (15), and a retention pin (30) in the same location as the previously described pivot joint (14). The blade system (50) may be comprised of heat treatable steel which can be through hardened to Rockwell "C" scale 48 or greater. Hardenable varieties of stainless steel may be used to provide corrosion resistance. The blade system (50) is configured with a lower surface of a first defined curvature and incorporates a blade (52) along the lower surface, a second blade system engagement portion configured as a retention hook (54) and a striker feature (56). A rotary retention latch (20) identical to the previously described embodiment is adapted to be pivotally mounted to the holder (3) at a latch pivot point (15) and contained within a substantially enclosed chamber (7) within the holder. The rotary retention latch (20) is configured with a release lever (8), an attachment engagement portion (21) and a pivot hole (22). The blade system (50) is adapted to be retained in the holder via the second blade system engagement portion configured as a retention hook (54) interlocking with the retention pin (30) and the rotary retention latch attachment engagement portion (21) interlocking with the striker (56) as in the previously described embodiment. The release lever (8) of the rotary retention latch (20) is adapted to be accessible through the aesthetic aperture (5) of the holder (3). In this manner the deficiencies of the DeMars prior art are overcome by eliminating the requirement for a highly complex shaped cavity in the holder and integrating the release lever (8) into the aesthetic aperture (5) prevents inadvertent release induced by contact with hockey sticks, pucks and the like.

The foregoing description is intended to be illustrative of preferred embodiments of the invention. Variations of the construction described will be obvious to those skilled in the art and are intended to be covered by this invention.

The invention claimed is:

1. An ice skate comprising:

(a) a boot;

(b) a holder having at least one substantially enclosed chamber and at least one aperture;

(c) a blade system with a lower surface of a first defined curvature and a first blade system engagement portion;

(d) the blade system comprising a blade along the lower surface;

(e) a rotary retention latch pivotally mounted to the holder and substantially located in the enclosed chamber of the holder for movement between a blade securing position and a blade releasing position;

(f) the rotary retention latch having an attachment engagement portion accessible through a first opening in the holder to the chamber and a release lever accessible through the at least one aperture, wherein the release lever is movable further into the enclosed chamber, to move the rotary retention latch from the blade securing position to the blade releasing position;

(g) at least one biasing device that biases the rotary retention latch to the blade securing position;

wherein the blade system is retained in the holder via the first blade system engagement portion, when extended through the first opening in the holder, detachably mating with the attachment engagement portion of the rotary retention latch, when the rotary retention latch is in the blade securing position.

2. The ice skate as defined in claim 1, wherein the blade system includes a second blade system engagement portion configured as a retention hook that detachably engages to a retention pin that is rigidly attached to the holder.

3. The ice skate as defined in claim 1, wherein the first blade system engagement portion comprises a striker feature.

4. The ice skate as defined in claim 1, wherein the attachment engagement portion is a pawl feature.

5. The ice skate as defined in claim 1, wherein the biasing device is a spring.

6. The ice skate as defined in claim 1, wherein the blade is integral with the blade system.

7. The ice skate as defined in claim 1, wherein the blade system comprises:

(a) a downward facing rocker with a lower surface of the first defined curvature, a front end and a rear end;

(b) a flexible replaceable blade having a second curvature when not attached to the rocker;

(c) the flexible replaceable blade having an upper surface, a lower ice-contacting surface, a front end and a rear end and being adapted to be removably mounted to the rocker;

(d) front securing means for attaching the front end of the flexible replaceable blade to the front end of the rocker;

(e) rear securing means for attaching the rear end of the flexible replaceable blade to the rear end of the rocker;

wherein the flexible replaceable blade conforms to the first defined curvature of the rocker when mounted thereon.

8. An ice skate comprising:

(a) a boot;

(b) a holder having at least one substantially enclosed chamber and at least one aperture;

(c) the holder incorporating an integral, downward facing rocker with a lower surface of a first defined curvature;

(d) the downward facing rocker having a fixed front end and rear end adapted to rotate between an open position and a closed position;

(e) a flexible replaceable blade having a second curvature when not attached to the skate;

(f) the flexible replaceable blade having an upper surface, a lower ice-contacting surface, a front end and a rear end and being adapted to be removably mounted to the rocker;

(g) front securing means for attaching the front end of the flexible replaceable blade to the fixed front end of the rocker;

(h) rear securing means for attaching the rear end of the flexible replaceable blade to the rotatable rear end of the rocker;

(i) a rotary retention latch pivotally mounted to the holder and substantially located in the enclosed chamber of the holder for movement between a blade securing position and a blade releasing position;

(j) the rotary retention latch having an attachment engagement portion accessible through a first opening in the holder to the chamber and a release lever accessible through the at least one aperture, wherein the release lever is movable further into the enclosed chamber, to move the rotary retention latch from the blade securing position to the blade releasing position wherein rotation of the rear end of the rocker between an open position and a closed position creates a tension along the length of the flexible replaceable blade without exerting the major component of tensioning force around a small radius in the region of the front and rear securing means and wherein the flexible replaceable blade conforms to the curvature of the lower surface of the rocker when mounted thereon, and the rotary retention latch retains the rotatable rear end of the rocker in the closed position when in the blade securing position.

* * * * *